US009810232B2

(12) United States Patent
Høj

(10) Patent No.: US 9,810,232 B2
(45) Date of Patent: Nov. 7, 2017

(54) PUMP UNIT

(71) Applicant: GRUNDFOS HOLDING A/S, Bjerringbro (DK)

(72) Inventor: Finn Mathiesen Høj, Aarhus N (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 442 days.

(21) Appl. No.: 14/368,993

(22) PCT Filed: Dec. 14, 2012

(86) PCT No.: PCT/EP2012/075510
§ 371 (c)(1),
(2) Date: Jun. 26, 2014

(87) PCT Pub. No.: WO2013/098093
PCT Pub. Date: Jul. 4, 2013

(65) Prior Publication Data

US 2014/0377103 A1 Dec. 25, 2014

(30) Foreign Application Priority Data

Dec. 27, 2011 (EP) ..... 11195803

(51) Int. Cl.
*F04D 29/08* (2006.01)
*F04D 13/06* (2006.01)

(52) U.S. Cl.
CPC ..... *F04D 29/086* (2013.01); *F04D 13/0606* (2013.01)

(58) Field of Classification Search
CPC ..... F04D 13/0606; F04D 13/0613; F04D 13/0635; F04D 29/086; F04D 29/08; F04D 29/165; F16L 17/025; F16L 17/03; F16L 17/032; F16L 17/06; F16L 17/067; F16L 15/04; F16L 21/04; F16L 21/06; F16L 21/02; F16L 21/03; F16J 15/028; F16J 15/02; F16J 15/021; F16J 15/022; F16J 15/024
USPC ..... 285/374, 368
See application file for complete search history.

(56) References Cited

U.S. PATENT DOCUMENTS 3,138,105 A 6/1964 White
3,256,829 A * 6/1966 Schneider ..... H02K 5/128 310/43
3,288,073 A * 11/1966 Pezzillo ..... F04D 13/0613 310/86
3,472,523 A * 10/1969 Carlson, Jr. ..... F16J 15/024 277/649

(Continued)

FOREIGN PATENT DOCUMENTS

CN 2480588 Y 3/2002
DE 38 03 774 A1 8/1989

(Continued)

*Primary Examiner* — Charles Freay
*Assistant Examiner* — Kenneth J Hansen
(74) *Attorney, Agent, or Firm* — McGlew and Tuttle, P.C.

(57) ABSTRACT

A pump assembly with a stator housing (18), in whose inside a wet-running electric motor with a can (14) is arranged, and with a pump housing (2) connected to the stator housing (18). An annular shaped seal (22) is arranged between the stator housing (18) and a collar (34) of the can (14) on the one hand, and the pump housing (2) on the other hand.

20 Claims, 4 Drawing Sheets

(56) References Cited

U.S. PATENT DOCUMENTS

| | | | | |
|---|---|---|---|---|
| 4,205,424 | A * | 6/1980 | Nagao | B25B 27/0028 29/407.1 |
| 6,409,175 | B1 * | 6/2002 | Evans | E21B 17/042 277/314 |

FOREIGN PATENT DOCUMENTS

| | | | | |
|---|---|---|---|---|
| DE | 198 00 302 | A1 | 7/1999 | |
| DK | DE 3803774 | A1 * | 8/1989 | F04D 13/0613 |
| EP | 1 635 065 | A1 | 3/2006 | |
| JP | 2001 295797 | A | 10/2001 | |
| JP | 2003 222095 | A | 8/2003 | |
| WO | 2009/113434 | A1 | 9/2009 | |

* cited by examiner

PUMP UNIT

CROSS REFERENCE TO RELATED APPLICATIONS

This application is a U.S. National Phase Application of International Application PCT/EP2012/075510 filed Dec. 14, 2012 and claims the benefit of priority under 35 U.S.C. §119 of European Patent Application EP 11 195 803.9 filed Dec. 27, 2011, the entire contents of which are incorporated herein by reference.

FIELD OF THE INVENTION

The invention relates to a pump assembly with a stator housing, with an inside within which is arranged a wet-running electric motor with a can, and with a pump housing connected to the stator housing.

BACKGROUND OF THE INVENTION

Pump assemblies, for example heating circulation pump assemblies are known, which comprise a stator housing and a pump housing connected to the stator housing. A wet-running electric motor is arranged in the inside of the stator housing, i.e. the electric motor comprises a can or a canned pot, which is arranged between the rotor and the stator and seals the stator space with respect to the rotor space. Thereby, it known for the can at its axial end facing the pump housing to comprise a radially outwardly extending collar which in this region seals the stator housing at the interface to the pump housing, on the axial side. For this, it is known to arrange an annular shaped seal, for example a flat seal, between the pump housing and this collar. By way of this, one prevents fluid to be delivered, for example water, from penetrating outwards through the gap between the pump housing and the can.

SUMMARY OF THE INVENTION

With regard to these problems, it is an object of the invention to provide an improved pump assembly which permits a more reliable sealing between the can, pump housing and stator housing.

The pump assembly according to the invention, as with known pump assemblies, comprises a stator housing and a pump housing. These are connected to one another and form a construction unit. In the known manner, at least one impeller which is driven via a shaft by the electric motor arranged in the stator housing, can be arranged in the pump housing. This electric motor is designed in a wet-running manner, i.e. it comprises a can or a canned pot between the motor stator and the motor rotor which seals the rotor space with respect to the stator space. The rotor of the electric motor is connected to the shaft driving the impeller.

The can, on its axial end which faces the pump housing, comprises a radially outwardly directed collar which serves for sealing with respect to the pump housing. For this, an annular shaped seal is arranged between this collar of the can on the one hand and the pump housing on the other hand. By way of this shaped seal, one prevents fluid from penetrating out of the inside of the pump housing or of the can, through the interface between the pump housing and the can, to the outside.

The shaped seal moreover has a further sealing function, by way of it, at its side which is away from the pump housing, not only bearing on the can, but also on the stator housing. Thus the shaped seal can simultaneously seal the stator space between the stator housing and the can, to the outside. The shaped seal thus preferably has three sealing functions, on the one hand it seals the fluid-filled space of the pump to the outside, on the other hand it seals this space with respect to the stator space and thirdly it seals the stator space to the surroundings, so that no moisture can penetrate into the stator space from the outside. The manufacture and assembly of the pump assembly is significantly simplified, since this can thus be realized alone with one seal.

Preferably, the shaped seal is designed in a manner such that in limited peripheral sections, free spaces are present between the inner periphery of the shaped seal and a radially inwardly oppositely lying wall which is preferably formed on the can. Alternatively or additionally, free spaces can be present in limited peripheral sections, between the outer periphery of the shaped seal and a radially outwardly oppositely lying wall which is preferably formed on the pump housing.

The free spaces extend only over limited peripheral sections, i.e. not over the whole periphery. The individual free spaces are thus disconnected by the sections which project further inwards in the radial direction if the free spaces are formed on the inner periphery of the shaped seal, or by further outwardly projecting sections, if the free spaces are formed on the outer periphery of the shaped seal. The free spaces are thus designed such that the shaped seal can expand into the free spaces, given an axial compression, i.e. when the can and the pump housing are pressed against one another. Due to the fact that the shaped seal can thus expand transversely to its compression direction, i.e. essentially in the radial direction, by a certain amount, the occurring stresses are reduced, so that as a whole the forces which are required in order to bring the shaped seal into sealing bearing contact on the pump housing and on the collar of the can are reduced. The compression of the shaped seal is preferably produced by way of screwing the stator housing and the pump housing. Thus, due to the reduction of the stresses with the compression of the shaped seal, the forces to be mustered on screwing the stator housing and the pump housing are reduced, which is particularly advantageous if the pump housing and/or the stator housing are formed from plastic, since these can deform or become damaged by way of forces which are too large.

It is to be understood that the preferred design of the shaped seal with the described free spaces could also be effected independently of the above described arrangement of the shaped seal between the stator housing, can and pump housing. This means that a shaped seal with such free spaces could also be used if the shaped seal is merely arranged between the collar of the can and the pump housing, or merely between the stator housing and the pump housing.

According to a preferred embodiment, the shaped seal in peripheral sections between the free spaces, bears on the oppositely lying wall. I.e. if the free spaces are formed on the inner periphery of the shaped seal, the shaped seal with its peripheral sections between the free spaces and which project further radial inwards, can bear on an oppositely lying wall which can in particular be formed on the can. If the free spaces are formed on the outer periphery of the shaped seal, the peripheral sections between the free spaces which project radially further outwards, can accordingly bear on an outer, oppositely lying wall, in particular on a wall formed in the pump housing. Thus, the seal can be positioned and in particular centered.

If the free spaces are formed on the inner periphery of the shaped seal, then preferably several radially inwardly directed prominences which are situated between the free spaces and which are arranged distributed over the periphery, in particularly distributed uniformly over the periphery, are formed on the inner periphery of the shaped seal. I.e. these prominences separate the free spaces from one another and, as the case may be, can come into bearing contact on an oppositely lying wall.

Vice versa, if the free spaces are formed on the outer periphery of the shaped seal, then several radially outwardly directed prominences which are distributed over the periphery, preferably uniformly over the periphery, can be formed on the outer periphery of the shaped seal, between which prominences the free spaces are situated. These prominences thus delimit the free spaces on the outer periphery.

The inner periphery or the outer periphery of the shaped seal preferably has a circular basic shape. I.e. even if the free spaces are designed with prominences lying therebetween, the basic shape of the shaped seal is circular. Thus, for example, the prominences can extend radially inwards or outwards from a circular basic shape, in order to define the free spaces on the outer and/or inner periphery which lie between the prominences.

Particularly preferably, the outer periphery of the shaped seal is circular with a peripheral wall free of radial indentations or prominences. I.e. with this embodiment, the free spaces are only arranged on the inner periphery of the shaped seal. This simplifies the insertion of the seal into the pump housing if this seal is previously assembled on the can.

Further preferably, the pump housing on its axial side which faces the stator housing comprises an annular contact surface for the shaped seal, from which an annular wall extends in the axial direction, which surrounds the shaped seal on its outer periphery. I.e. an annular step is formed on the inner periphery of the pump housing, and the axial side of this step forms an annular contact surface for the shaped seal and its annular peripheral wall which is aligned transversely thereto, i.e. in particular extends normally thereto and surrounds the shaped seal on its outer periphery. Thereby, the shaped seal preferably with its outer periphery does not bear on this oppositely lying annular wall, but rather the shaped seal with its outer periphery is preferably arranged in the inside of the annular wall with play. The radial play between the outer periphery of the shaped seal and the surrounding annular wall thereby corresponds preferably roughly to half the radially extension of the free spaces which are provided on the inner periphery of the shaped seal.

This simplifies the centering of the stator housing with the can relative to the pump housing, since the shaped seal on the outer periphery does not come into contact with the pump housing and thus permits a radial movement for aligning or centering. Thus, the centering can be effected via a suitable surface on the can or on other components with a defined shape. Moreover, a free space between the outer periphery of the shaped seal and the surrounding annular wall permits a further expansion of the shaped seal in the radial direction, when the shaped seal is compressed in the axial direction.

According to a preferred embodiment, the radial collar of the can borders the stator housing in a manner such that a contact surface of the stator housing for the shaped seal extends in a plane with a contact surface of the can for the shaped seal. This permits a shaped seal with a plane axial side to come into sealing bearing contact on the contact surface of the stator housing as well as on the collar of the can.

An annular, axially directed projection is formed on the stator housing, preferably on an axial end which faces the pump housing and this projection forms the contact surface of the stator housing on the shaped seal. The end-side of this projection preferably lies in a plane with the contact surface of the can for the shaped seal, so that this shaped seal can come into sealing bearing contact on the axial end-side of the projection as well as on the contact surface of the can. The annular projection thereby extends preferably on the outer periphery around the radial collar of the can and has an axial length which corresponds at least to the thickness of the radial collar of the can. Thus, the projection can extend past the outer periphery of the collar, in order to come into sealing bearing contact with the shaped seal.

It is to be understood that the projection can have a radial width which is more than 50 percent of the radial width or wall thickness of the stator housing at the axial end facing the pump housing. Thus the radial collar of the can can also be accommodated in a graduation at the axial end of the stator housing, and the remaining wall region surrounding the graduation can form the axially directed projection.

The axial projection on the stator housing permits several sealing functions to be effected with one seal, specifically on the one hand the interface between the can and the pump housing can be sealed with respect to the stator space, on the other hand the interface between the can and the pump housing can be sealed to the outside and moreover the stator space can yet be sealed to the outside, so that no moisture can penetrate from the outside into the stator space. The axially directed projection on the stator housing thereby permits the contact surface of the stator housing on the seal and the contact surface of the can on the seal to be able to be formed lying next to one another.

Instead of stepping the stator housing on its axial side or providing it with an axial projection, the shaped seal can also be designed in a stepped manner, in order to permit a bearing contact on the collar of the can as well as also on the stator housing. Thus, for example, the axial side of the stator housing which faces the pump housing can be designed in a plane manner and the collar of the can can bear on the plane end-edge of the stator housing. The shaped seal could thus be designed in a stepped manner such that it has a larger thickness at its outer periphery than at its inner periphery, so that the region facing the inner periphery can then come to bear on the collar of the can, whilst the outer peripheral region with the greater thickness could extend past the outer periphery of the collar of the can and come into bearing contact directly with the axial end-side of the stator housing.

The contact surfaces of the can and the stator housing preferably lie radially next to one another, and the shaped seal covers an annular gap between the two contact surfaces. Thus the shaped seal seals the gap between the can and the stator housing to the outside, so that the stator space between the can and the stator housing is sealed to the outside and no moisture can penetrate from the outside into this space.

Preferably, the shaped seal has a rectangular cross section. I.e. the shaped seal in particular has two axial end-faces which are parallel to one another, of which a first one comes to bear on the radial collar of the can, and, as the case may be, on the stator housing, whilst the opposite second axial side comes to sealingly bear on the pump housing. Such a shaped seal can be designed for example as an injection moulded part of an elastomer or also be cut or punched from a flat material of elastomer.

According to a further preferred embodiment, a bearing carrier which carries a bearing for a rotor shaft is fastened on the can at the axial end of the can which faces the pump housing, wherein the shaped seal is held in the axial direction between the collar of the can and the bearing carrier. Thereby, the shaped seal can be held with play in the axial direction between the bearing carrier and the collar, so that it can move by a certain amount. The arrangement however permits the shaped seal to be attached on the can before the connection of the stator housing to the pump housing, and to fix it there with the help of the bearing carrier, so that this can no longer detach from the can. The assembly is simplified by way of this.

The bearing carrier engages over the can preferably on the outer periphery and comprises a radially outwardly projecting shoulder which bears on an axial side of the shaped seal. I.e. in the axial direction, the shaped seal is held on this shoulder, and the contact surface for the shaped seal is held on the can. This contact surface is preferably likewise provided on a radial prominence of the can.

Further preferably, the bearing carrier is designed in a plate-like manner and on its outer periphery comprises an angled, essential axially extending clamping surface which engages around the can on its outer periphery. The clamping surface can thereby comprise clamping projections or also annular bulges which serve for the non-positive clamping on the can. Thus, a simple non-positive fixation between the bearing carrier and the can is achieved. The bearing carrier can in particular be formed as a forming part of sheet-metal.

The can, departing from its open axial end, firstly preferably comprises a radially extending section of the collar, wherein a region which again extends axially, essentially parallel to the actual can and which forms a step whose peripheral surface engages around the bearing carrier, extends on this section. Departing from this axially extending section of the collar of the can, a peripheral prominence extends radially outwards and one axial side of this forms the contact surface for the shaped seal. The axially extending section or the step on the collar of the can is preferably machined in a material-removing manner, so that its outer periphery is centered to the middle axis of the can, and in this manner the bearing carrier which engages around this region, is likewise centered to the middle axis of the can and thus to the rotation axis of the rotor of the drive motor.

The bearing carrier in turn, preferably on its outer periphery, comprises a peripheral contact surface which serves for centering in the pump housing and is centered with respect to the middle axis of the bearing carrier and thus preferably with respect to the middle axis of the can or the rotation axis of the rotor. This peripheral section comes to bear on an inner peripheral surface of the pump housing and centers the bearing carrier and thus the can connected to the bearing carrier and thus the stator arranged on the can, with the stator housing, relative to the pump housing. A very simple assembly is achieved by way of this. The complete stator with the stator housing, the can, the shaped seal and the bearing carrier can be preassembled and then subsequently joined onto the pump housing, wherein the preassembled arrangement of the stator and of the stator housing is centered relative to the pump housing via the bearing carrier. Subsequently, the pump housing and the stator housing in the known manner are screwed by way of screws extending in the axial direction.

The peripheral contact surface of the bearing carrier, which serves for centering in the pump housing, is preferably a contact surface which is produced alone by forming a bearing carrier formed from sheet metal. Thus, one can make do without a material-removing machining of the bearing carrier, by which means the manufacture is simplified.

Particularly preferably, the clamping surface of the bearing carrier which bears on the can, and the contact surface which serves for centering in the pump housing, is formed by a peripheral wall of the bearing carrier which is bent in an S-shaped manner in cross section. I.e. this peripheral wall which has been described above as extending essentially in the axial direction, strictly speaking has an S-shaped cross section, by which means a radially inwardly clamping bead is formed, which in a clamping manner comes into bearing contact on the can or, in the axially extending section of the step, on the collar of the can, and a radially outwardly directed clamping bead which for centering comes to bear on an inner surface of the pump hosing. Both clamping beads can be formed by way of forming a sheet-metal part. Instead of annular clamping beads, one can also form individual radial bulges which are limited to only one peripheral region, inwardly and outwardly, for the fixation on the can or for centering in the pump housing. Such bulges are then distributed over the periphery, in particular, are distributed uniformly over the periphery.

The pump assembly is preferably a circulation pump assembly and is in particular designed as a heating pump assembly.

The invention is hereinafter described in more detail by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
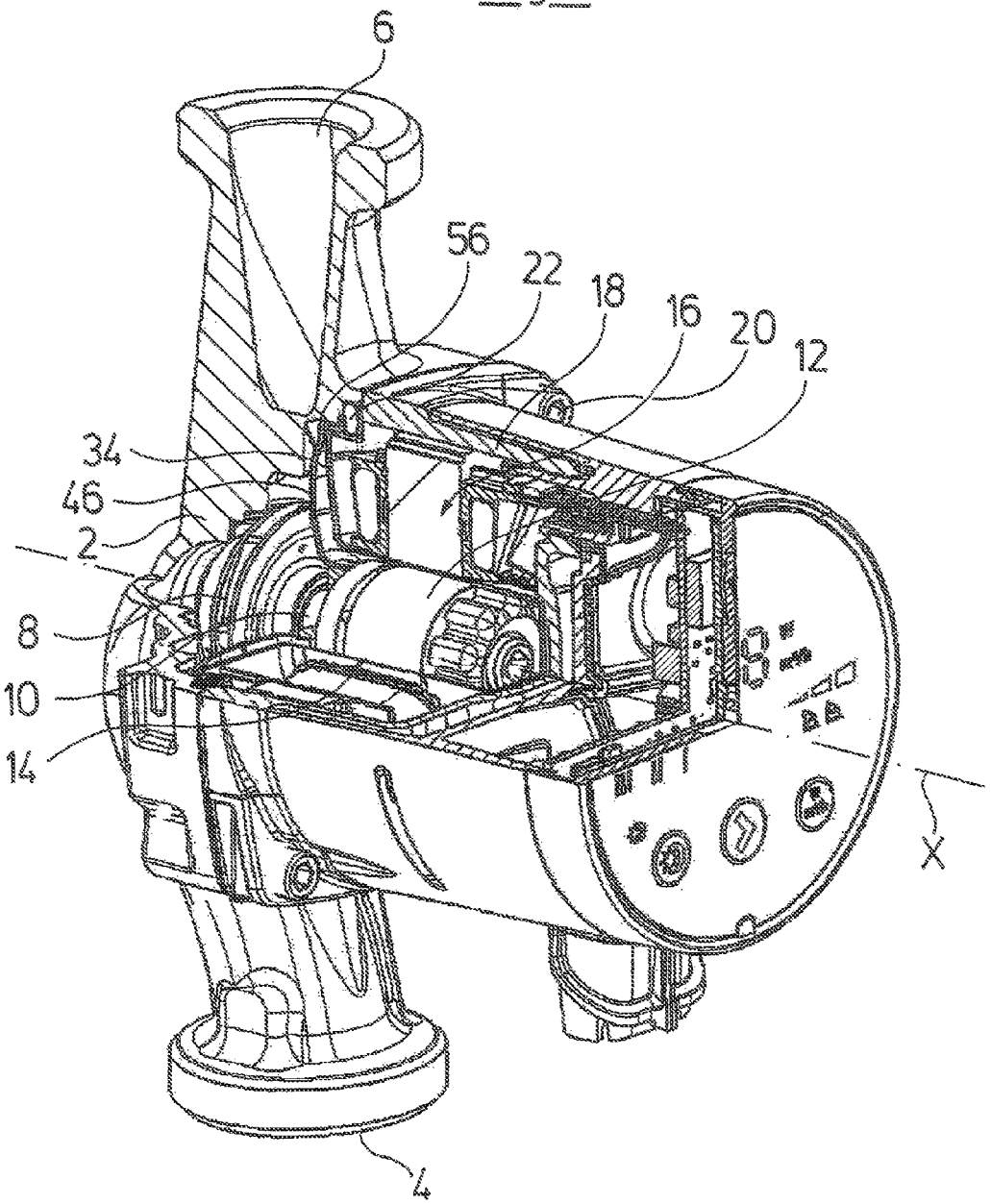
FIG. 1 is a partly sectioned perspective total view of a pump assembly according to the invention.

Referring to the drawings in particular, the pump assembly shown in the figures is a heating circulation pump assembly and comprises a pump housing 2 which in the known manner is provided with a suction union 4 and with a pressure union 6. An impeller 8, which is connected via a rotor shaft 10 to the rotor 12 of an electric motor, is arranged in the inside of the pump housing 2. The rotor 12 is arranged in the inside of a can or a canned pot 14 which is surrounded peripherally by the stator 16 of the electric motor. With this design, it is the case of a wet-running electric motor, i.e. the rotor space in the inside of the canned pot 14 is filled by the fluid to be delivered.

The stator 16 is arranged in the inside of a stator housing 18. The stator housing 18, seen in the longitudinal direction X, i.e. in the direction of the rotation axis of the rotor 12, is screwed at one axial end to the pump housing 2 by way of screws 20. A seal 22 is arranged between the pump housing 2 and the stator housing 18.

The seal 22 in this pump assembly simultaneously assumes several sealing functions. Thus, the seal on the one hand seals the pump space, in which the fluid to be delivered is located, to the outside, and on the other hand with respect to the stator housing. Moreover, the seal 22 seals the stator housing to the outside, so that no moisture can penetrate from the outside into the stator housing. This is explained hereinafter in more detail in particular with reference to FIGS. 2 and 4.

Figure 2:
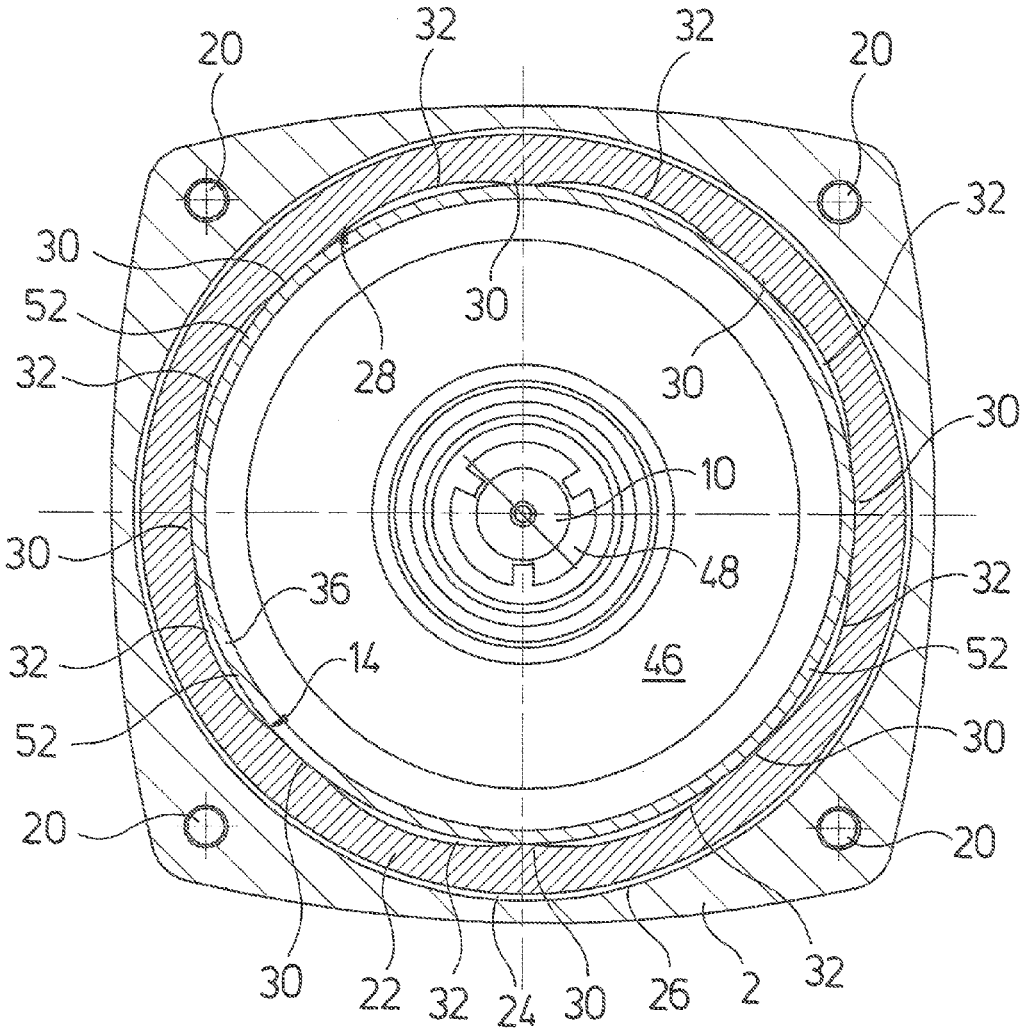
FIG. 2 is a sectioned view through the pump housing with an inserted seal, along the line II in FIGS. 3 and 4.

As is to be recognized in the sectioned view in FIG. 2, the seal 22 is designed as a shaped seal with a circular basic shape. The seal 22 has a circular outer periphery 24 which lies opposite an annular wall 26 in the pump housing 2. Thereby, the outer periphery 24 is distanced to the annular wall 26, so that a free space remains. The inner periphery 28 of the seal 22 likewise has a circular basic shape. However, several radially inwardly directed prominences 30 are formed on the inner periphery 28. In the shown example, eight prominences 30 are provided, which are arranged uniformly distributed over the inner periphery 28. Free spaces 32 are formed between the prominences 30. The prominences 30 bear with their radially inwardly lying apex regions on the outer periphery of the canned pot 14. In the region of the free spaces 32, the inner periphery 28 of the seal 22 is radially distanced to the outer periphery of the canned pot 14. The free spaces 32 serve for permitting the seal 22 to be able to expand into the free spaces 32 when it is compressed in the axial direction X, so that the axial forces which act between the pump housing 2 and the stator housing 18 are reduced. With this embodiment example, the seal 22 can also expand into the free space between the outer periphery 24 and the annular wall 26 by a certain amount. The radial distance between the outer periphery 24 and the annular wall 26 thereby with this example is however only half as large as the radial distance between the inner periphery 28 and the outer periphery of the canned pot 14 in the region of the free spaces 32.

Figure 4:
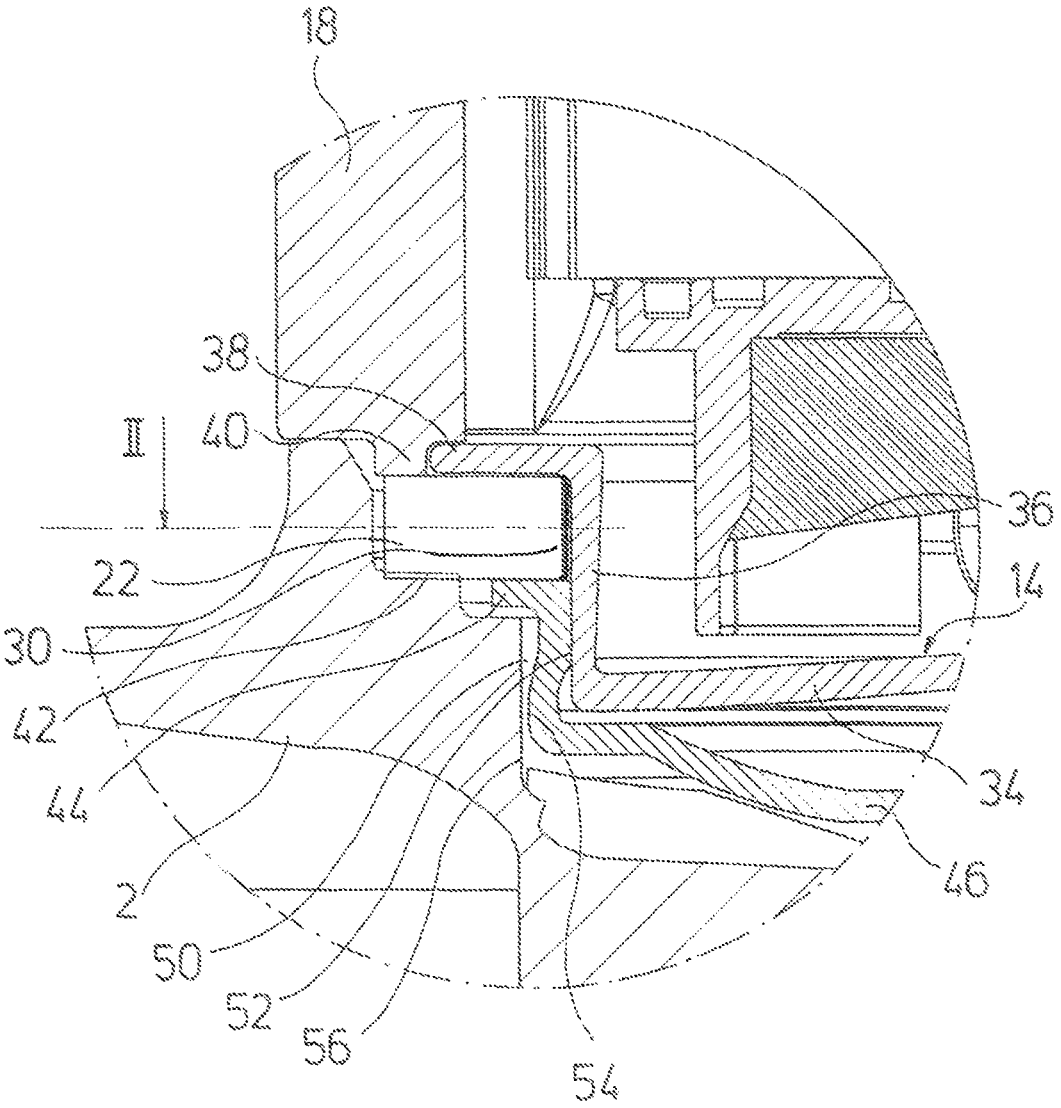
FIG. 4 is a sectioned detail view of the connection region between the pump housing and stator housing in a detail, at a diametrically opposite side in comparison to FIG. 3.

The canned pot 14 at its axial end which faces the pump housing 2 comprise a radially outwardly extending collar 34 which is bent over twice by 90° on its outer periphery, so that a step with an axial wall 36 and an end region 38 which again extends radially are is formed. The seal 22 bears with its prominences 30 on the axial wall 36 of the canned pot 14, as is shown in FIG. 4. In the region of the free spaces 32, the inner periphery 28 of the seal 22 is distanced to the axial wall 36.

The end region 38 forms a contact surface which lies in a sealing manner on an axial side of the seal 22. The end region 38 on the outer periphery is peripheral surrounded by a projection 40 which projects from the axial end of the stator housing 18. Thereby, the axial height of the projection 40 corresponds essentially to the thickness of the end region 38 of the canned pot 14. The axial end-side of the projection 40 forms a contact surface and likewise bears in a sealing manner on the axial side of the seal 22. Thus, the axial end-side of the projection and the contact surface on the end region 38 of the canned pot 14, essentially in a plane transverse to the longitudinal or rotation axis X bear on the seal 22 in a sealing manner radially next to one another. Thus the gap between the end region 38 of the canned pot 14 and the projection 40 of the stator housing is covered by the seal 22 and sealingly closed, so that no moisture from outside can penetrate through this gap into the inside of the stator housing.

With the opposite axial end-side, the seal 22 bears on an annular contact surface 42 on the axial end-side of the pump housing 2. The axial contact surface 42 is surrounded by the annular wall 26. The contact surface 42 and the annular wall 26 thus form an annular step in the inside of the pump housing 2 for receiving the seal 22. On screwing the pump housing 2 and the stator housing 18 onto one another, the seal 22 is compressed in the axial direction, which is indicated schematically in FIGS. 3 and 4 by the overlapping of the seal 22 with the contact surface 42. The gap between the canned pot 14 or its end region 38 and the pump housing 2 is sealingly closed by the seal 22, by way of the sealed bearing contact of the seal 22 on the contact surface 42. The pump space, in which the impeller 8 is arranged, as well as the inside of the canned pot 14, in which likewise the fluid to be delivered is located, is sealed to the outside in this manner. Simultaneously, the seal 22 also ensures that the inside of the stator housing 18 outside the canned pot 14 is sealed with respect to the pump space, in which the impeller 8 is arranged, so that the fluid to be delivered cannot penetrate into the inside of the stator housing 18.

By way of the free spaces 32, it is possible for the seal 22 to expand inwards in the radial direction into the free spaces 32 on screwing the stator housing 18 and the pump housing 2 onto one another and with the axial compression of the seal 22, so that the occurring stresses and thus the axial forces between the stator housing 18 and the pump housing 2 caused by way of the elastic deformation of the seal 22 in the axial direction X, are reduced. This, in particular, is advantageous if the pump housing 2 is formed from plastic, since in such a case, the screw connection formed by the screws 20 cannot accommodate such large forces, as is common with a pump housing 2 of metal. There exists the danger of the screws 20 being torn out or of a deformation of the pump housing 2. The pump housing 2 should not come into direct bearing contact with the stator housing 18 at its axial end, but the pump housing 2 as well as the stator housing 18 firstly bear each only on the opposite axial sides of the seal 22, and only after compressing the seal 22 can the axial end of the stator housing 18 and the pump housing 2 come into bearing contact. By way of this dimensioning of the seal 22, one succeeds in this seal always firstly being compressed in the axial direction, so that a sealing bearing contact on the contact surface 42 is always ensured, and on the contact surface on the end region 38 and on the axial side of the projection 40 on the opposite side. Thus, a permanent sealed bearing contact of the seal 22 is achieved.

Figure 3:
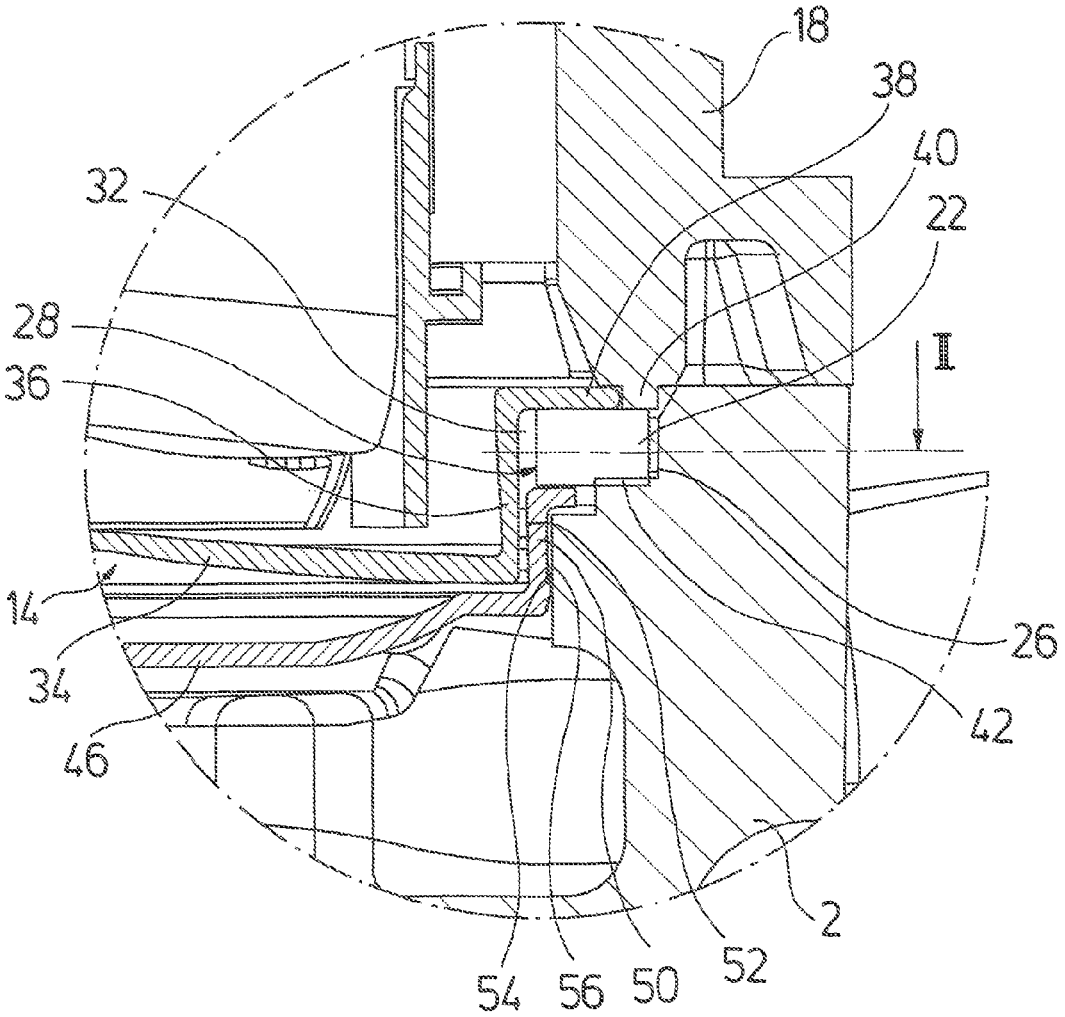
FIG. 3 is a sectioned detail view of the connection region between the pump housing and the stator housing.

As is to be recognized in the FIGS. 3 and 4, the seal 22 is held on the canned pot 14, i.e. in the peripheral region of the axial wall 36 between the end region 38 and a radially extending shoulder 44 of a bearing plate 46. The bearing plate 46 is formed from sheet-metal and in its central region carries a bearing 48 for the rotor shaft 10. The bearing plate 46 designed in a disk-like manner with an essentially circular outer periphery, wherein in the vicinity of its outer periphery, it has an essentially axially extending peripheral wall 50 which engages around the axial wall 36 of the canned pot 14, on the outer periphery. The end region of the peripheral wall 50 is bent over radially outwards in the form of the shoulder 44. The complete bearing carrier or the complete bearing plate 46 is designed as a forming part from sheet-metal. The peripheral wall 40 on its inner periphery comprises radially inwardly directed projections 52 which form clamping surfaces which come into clamping bearing contact on the outer periphery of the axial wall 36 of the canned pot 14. In the example shown here, several projections 52 distributed uniformly over the periphery are provided on the peripheral wall 50, in order to clamp the bearing plate 46 on the canned pot 14 and to simultaneously center the bearing plate 46 on the canned pot 14. Instead of several individual projections 52, a single annular projection can also be formed on the periphery of the peripheral wall 50 for clamping on the axial wall 36. The axial wall 36 is machined in a material-removing manner on its outer periphery, in particular is lathed down or ground, in order to center this outer side of the axial wall 36 with respect to the middle or longitudinal axis X. The bearing plate 46 is designed by way of forming such that the inner sides of the projections 52 are arranged in a centered manner. Thus, the complete bearing plate 46 can be attached on the can 14, in a manner in which it is centered to this.

On the outer periphery, the peripheral wall 50 comprises radially outwardly directed projections 54 in a manner axially distanced to the projections 52, and these projections 54 serve for centering the bearing plate 46 in the inside of the pump housing 2. For this, the radially outwardly directed projections 54 come into bearing contact with a circular-cylindrical inner surface 56 of the pump housing 2, wherein the inner surface 56 is likewise centered essentially to the rotation axis X. The projections 54 can likewise be designed as individual projections which are distributed over the periphery, or however as a continuous, radially outwardly directed projection 54. The projection 54 is created alone by way of forming the sheet-metal part which forms the bearing plate 46.

For the assembly of the stator on the pump housing, one envisages the stator 16 with the canned pot 14 being firstly arranged on the inside of the stator housing 18. The seal 22 thereby is arranged on the outer periphery of the axial wall 36 of the canned pot 14, and subsequently the bearing plate 46 is placed onto the outer periphery of the axial wall 36 and clamped there. Thereby, the seal 22 is held in the axial direction, between the end region 38 of the canned pot 14 and the shoulder 44 of the bearing plate 46. This does not need to be without play, and rather it is preferably for play to be given in this region in the axial direction, so that the seal 22 between the shoulder 44 and the end region 38 is not compressed.

The thus pre-assembled stator in the stator housing 18 with the rotor 12 arranged therein and the impeller 8 is then applied axially onto the pump housing 2. Thereby, the bearing plate 46 with its projections 54 on the outer periphery enters into the region spanned by the inner surface 56, and the projections 54 center the complete stator with the stator housing and the canned pot 14, to the pump housing 2. Subsequently, the pump housing 2 and the stator housing 18 are screwed to one another via the screws 20, wherein the seal 22 as described above, is compressed and thus comes into sealing bearing contact with the contact surface 42, the end-side of the projection 40 and the axial side of the end region 38.

While specific embodiments of the invention have been shown and described in detail to illustrate the application of the principles of the invention, it will be understood that the invention may be embodied otherwise without departing from such principles.

The invention claimed is:

1. A pump assembly comprising:

a stator housing comprising a longitudinal axis, an inside and a stator housing end portion surface at an axial end of the stator housing, the stator housing end portion surface extending in a radial direction with respect to the longitudinal axis;

a wet-running electric motor with a can arranged in the stator housing inside;

a pump housing connected to the stator housing; and an annular shaped seal arranged between the stator housing and a radial collar of the can, and the pump housing, the annular shaped seal comprising a shaped seal side facing away from the pump housing, the shaped seal side being in contact with the can and the stator housing end portion surface, wherein at least one of:

in predetermined peripheral sections, free spaces are present between the inner periphery of the shaped seal and a radially inwardly oppositely lying wall of the can; and in predetermined peripheral sections, free spaces are present between the outer periphery of the shaped seal and a radially outwardly oppositely lying wall of the pump housing, wherein said free spaces are designed in a manner such that the shaped seal can expand into the free spaces with an axial compression.

2. A pump assembly according to claim 1, wherein the shaped seal, in the peripheral sections between the free spaces, bears on the oppositely lying wall, the pump housing being in contact with another side of the shaped seal, the shaped seal side being located axially opposite the another side of the shaped seal with respect to a longitudinal axis of the shaped seal, wherein the axial compression is provided via force applied to at least the stator housing and the can, said force being applied in a direction parallel to the longitudinal axis, said shaped seal expanding in a direction transverse to longitudinal axis.

3. A pump assembly according to claim 1, wherein several radially inwardly directed prominences are formed on the inner periphery of the shaped seal, arranged distributed over the periphery, between which prominences the free spaces are situated, the prominences comprising wall contact surfaces.

4. A pump assembly according to claim 1, wherein several radially outwardly directed prominences are formed on the outer periphery of the shaped seal, arranged distributed over the periphery, between which prominences the free spaces are situated, the prominences comprising wall contact surfaces.

5. A pump assembly according to claim 1, wherein at least one of the inner periphery and the outer periphery of the shaped seal has a circular basic shape.

6. A pump assembly according to claim 1, wherein the outer periphery of the shaped seal is designed in a circular manner with a peripheral wall free of radial indentations or prominences.

7. A pump assembly according to claim 1, wherein the pump housing on its axial side, which faces the stator housing, comprises an annular contact surface for the shaped seal, from which contact surface an annular wall of the pump housing extends in the axial direction, said annular wall surrounding the shaped seal on an outer periphery thereof.

8. A pump assembly according to claim 7, wherein the outer periphery of the shaped seal is arranged with play in the inside of the annular wall.

9. A pump assembly according to claim 1, wherein the radial collar of the can is adjacent the stator housing in a manner such that a contact surface of the stator housing for the shaped seal extends in a plane with a contact surface of the can for the shaped seal.

10. A pump assembly according to claim 9, wherein an annular axially directed projection is formed on the stator housing at an axial end which faces the pump housing, said projection forming the contact surface of the stator housing on the shaped seal.

11. A pump assembly according to claim 9, wherein the contact surfaces of the can and stator housing lie radially next to one another and the shaped seal covers an annular gap between the two contact surfaces.

12. A pump assembly according to claim 1, wherein the shaped seal has a rectangular cross section.

13. A pump assembly according to claim 1, further comprising:

a rotor shaft; and a bearing carrier fastened on the can at the axial end of the can which faces the pump housing wherein the bearing carrier carries a bearing for the rotor shaft, wherein the shaped seal is held in the axial direction between the collar of the can and the bearing carrier.

14. A pump assembly according to claim 13, wherein the bearing carrier engages around the can on an outer periphery and comprises a radially outwardly projecting shoulder which engages an axial side of the shaped seal, said axial side being located axially opposite said shaped seal side with respect to a longitudinal axis of said shaped seal.

15. A pump assembly according to claim 13, wherein the bearing carrier is designed in a plate-like manner and has an outer periphery that comprises an angled, axially extending clamping surface which engages over the can on its outer periphery.

16. A pump assembly according to claim 15, wherein the bearing carrier has an outer periphery that comprises a peripheral contact surface which is centered with respect to a middle axis of the bearing carrier and which serves for centering in the pump housing.

17. A pump assembly according to claim 16, wherein the clamping surface of the bearing carrier, which bears on the can, and the contact surface which serves for centering in the pump housing, are formed by a peripheral wall of the bearing carrier which in cross section is bent in an s-shaped manner.

18. A pump assembly according to claim 14, wherein the can on the radial collar comprises a step with a peripheral surface that engages around the bearing carrier.

19. A pump assembly according to claim 1, wherein the pump comprises a heating circulation pump assembly.

20. A pump assembly comprising:

a stator housing comprising a stator housing end portion and a stator housing inside, said stator housing end portion comprising a stator housing end portion surface;

a wet-running electric motor comprising a can arranged in the stator housing inside;

a pump housing connected to the stator housing; and an annular shaped seal arranged between the stator housing, a radial collar of the can and the pump housing, the annular shaped seal comprising a shaped seal longitudinal axis, a first shaped seal side surface and a second shaped seal side surface, said first shaped seal side surface being located axially opposite said second shaped seal side surface with respect to the shaped seal longitudinal axis, said stator housing end portion surface and said second shaped seal side surface extending in a radial direction with respect to the longitudinal axis, at least a portion of said second shaped seal side surface being in direct contact with said pump housing, said first shaped seal side surface facing in a direction away from said pump housing, said first shaped seal side surface comprising a first shaped seal side surface first portion and a first shaped seal side surface second portion located adjacent to said first shaped seal side surface first portion, each of said first shaped seal side surface first portion and said first shaped seal side surface second portion extending in said radial direction with respect to the longitudinal axis, said first shaped seal side surface first portion being in direct contact with said can, said first shaped seal side surface second portion being in direct contact with said stator housing end portion surface, wherein in predetermined peripheral sections, free spaces are present one of:

between the inner periphery of the shaped seal and a radially inwardly oppositely lying wall of the can; and between the outer periphery of the shaped seal and a radially outwardly oppositely lying wall of the pump housing, wherein said shaped seal expands into said free spaces when said shaped seal is compressed in an axial direction with respect to the shaped seal longitudinal axis.

* * * * *